US010099907B1

(12) United States Patent
Brady

(10) Patent No.: US 10,099,907 B1
(45) **Date of Patent: *Oct. 16, 2018**

(54) SYSTEM AND METHOD FOR THERMAL PROTECTION OF AN ELECTRIC WINCH

(71) Applicant: Ramsey Winch Company, Tulsa, OK (US)

(72) Inventor: Todd Brady, Tulsa, OK (US)

(73) Assignee: Ramsey Winch Company, Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/797,690

(22) Filed: Oct. 30, 2017

Related U.S. Application Data

(63) Continuation of application No. 14/825,561, filed on Aug. 13, 2015, now Pat. No. 9,802,797.

(60) Provisional application No. 62/038,062, filed on Aug. 15, 2014.

(51) Int. Cl.

| | |
|---|---|
| ***B66D 1/54*** | (2006.01) |
| ***B66D 1/48*** | (2006.01) |
| ***B66D 1/14*** | (2006.01) |
| ***B66D 1/12*** | (2006.01) |

(52) U.S. Cl.
CPC ..... *B66D 1/54* (2013.01); *B66D 1/12* (2013.01); *B66D 1/14* (2013.01); *B66D 1/485* (2013.01)

(58) Field of Classification Search
CPC ... B66D 1/12; B66D 1/14; B66D 1/54; B66D 1/485
See application file for complete search history.

(56) References Cited

U.S. PATENT DOCUMENTS

| | | | | |
|---|---|---|---|---|
| 4,331,323 A * | 5/1982 | Sekimori | B60S 11/00 | 242/390.8 |
| 4,636,962 A * | 1/1987 | Broyden | B66D 1/485 | 212/281 |
| 4,908,538 A * | 3/1990 | Geberth, Jr. | H02K 5/20 | 310/227 |
| 4,914,329 A * | 4/1990 | Ottersbach | H01H 37/043 | 310/68 C |
| 5,214,359 A * | 5/1993 | Herndon | H02H 1/0007 | 318/434 |
| 5,361,565 A * | 11/1994 | Bayer | A63J 1/028 | 254/270 |
| 5,790,407 A * | 8/1998 | Strickland | G05B 19/042 | 212/284 |

(Continued)

FOREIGN PATENT DOCUMENTS

| | | |
|---|---|---|
| CN | 201614251 | 2/2010 |
| CN | 203402872 | 8/2013 |

(Continued)

OTHER PUBLICATIONS http://www.jandihitch.com/WinchProdCatalog.pdf [See 9.5cti Contactor Equipped, Thermometric on p. 204].

(Continued)

*Primary Examiner* — Michael E Gallion
(74) *Attorney, Agent, or Firm* — Gable Gotwals

(57) ABSTRACT

Monitoring the temperature of the brush of the motor on an electric winch during operation and restricting the operation of the motor within a cooling range in order to minimize downtime and maximize runtime.

12 Claims, 2 Drawing Sheets

(56) References Cited

U.S. PATENT DOCUMENTS

| | | | | |
|---|---|---|---|---|
| 5,859,373 | A * | 1/1999 | Munzebrock | B66C 13/16 73/862.193 |
| 6,220,046 | B1 * | 4/2001 | Kristen | B23Q 11/10 62/259.2 |
| 6,222,289 | B1 * | 4/2001 | Adames | H02K 5/20 310/52 |
| 6,431,103 | B1 * | 8/2002 | Meyerdierks | B63B 21/16 114/218 |
| 6,864,650 | B2 | 3/2005 | Heravi et al. | |
| 6,874,763 | B2 * | 4/2005 | Sozzi | B66D 1/12 254/278 |
| 7,789,374 | B2 | 9/2010 | Averill et al. | |
| 8,213,137 | B2 * | 7/2012 | Fregoso | B60L 15/2009 318/432 |
| 9,802,797 | B2 * | 10/2017 | Brady | B66D 1/54 |
| 2004/0194497 | A1 * | 10/2004 | Sasaki | F01P 3/20 62/505 |
| 2004/0263100 | A1 * | 12/2004 | Heravi | B60P 3/12 318/280 |
| 2007/0103821 | A1 * | 5/2007 | Huang | H02H 7/0852 361/26 |
| 2008/0061276 | A1 * | 3/2008 | Averill | B66D 1/22 254/323 |
| 2009/0309082 | A1 * | 12/2009 | Webb | B66D 1/12 254/340 |
| 2010/0191417 | A1 * | 7/2010 | Murahashi | B60B 11/06 701/36 |
| 2011/0084245 | A1 * | 4/2011 | Penenburgh | B66F 3/18 254/2 R |
| 2014/0257631 | A1 * | 9/2014 | Heravi | B66D 1/42 701/36 |
| 2015/0097450 | A1 | 4/2015 | Xu et al. | |
| 2015/0284221 | A1 | 10/2015 | Hall et al. | |
| 2015/0284229 | A1 | 10/2015 | Hall et al. | |
| 2015/0284230 | A1 * | 10/2015 | Hall | B66D 5/32 254/357 |
| 2016/0046468 | A1 * | 2/2016 | Heravi | B66D 1/40 715/835 |
| 2016/0046469 | A1 * | 2/2016 | Brady | B66D 1/54 254/342 |
| 2016/0107863 | A1 * | 4/2016 | Strbuncelj | B66B 11/043 310/53 |

FOREIGN PATENT DOCUMENTS

| | | |
|---|---|---|
| DE | 3424590 | 1/1986 |
| JP | H05229785 | 9/1993 |
| JP | 11209081 | 8/1999 |
| WO | 2009092273 | 7/2009 |

OTHER PUBLICATIONS http://www.bulldogwinch.com/pdf/2014rev2Bulldog_Catalog.pdf [See 9300lb Alpha].
http://www.lewmar.com/product-listing.asp?action=search&type=104.

* cited by examiner

SYSTEM AND METHOD FOR THERMAL PROTECTION OF AN ELECTRIC WINCH

PRIORITY CLAIMS

The present application is a continuation-in-part of U.S. Provisional Patent Application No. 62/038,062, entitled System and Method for Thermal Protection of an Electric Winch, filed on Aug. 15, 2014 which is incorporated herein by reference.

1. FIELD OF THE INVENTION

The present invention relates generally to a system and method for controlling the motor of an electric winch. More particularly, the present invention relates to a system and method that prevents thermal damage to the motor of an electric winch while optimizing run time.

2. BACKGROUND OF THE INVENTION

Electric winches typically have lighter load ratings and shorter duty cycles when compared to hydraulic winches of comparable size. When fully loaded, electric winches can only be operated a short time before heat builds up to dangerous levels in the motor. This heat buildup can cause permanent damage to the motor and winch if left unchecked. However, electric winches are lighter and less expensive to install than hydraulically driven winches. This cost advantage has led to increased interest in the use of electric winches in applications where a hydraulic winch has traditionally been used.

What is needed, therefore, is a system or method for protecting an electric winch from damage caused by overheating.

Further what is needed is a system and method that optimizes runtime in the duty cycle of an electric winch.

DESCRIPTION OF THE INVENTION

The present invention achieves its objectives by monitoring the temperature of the electric motor. Various locations on the electric motor may be monitored for temperature during operation. In the preferred embodiment, the temperature of the brush of the electric motor is monitored during operation. The brush is a key component of the electric motor and is the site where much of the heat from operation is generated. Thus, if the brush does not overheat the rest of the motor will not overheat.

The temperature can be monitored by different types of devices. In the preferred embodiment, the temperature is monitored using a thermocouple. Thermocouples provide accurate temperature readings in the form of an electronic signal that can be readily interpreted and used by various electronic devices. Further, they are responsive to changes in the temperature. They do not have any thermal mass themselves that must also cool before they can sense the change in the brush.

In the preferred embodiment, the electronic signal is transmitted to a control circuit or other electronic control device. Initially, the winch and brush start at or near ambient temperature. This is typically well below 176° C. When the temperature of the brush reaches 212° C., the controller circuit terminates operation of the winch motor. This is accomplished by the opening of a relay or solenoid thus terminating the connection between the voltage supply source and the motor. This provides time for the motor to cool. Once the temperature of the brush reaches 176° C. the control circuit closes the relay. This returns the power supply to the motor and reinstates operation of the motor. This operating range may vary based on the metallurgy of the brush and motor and other cooling characteristics. These variations would be necessary to match the optimum range in the cooling curve.

Thus, in operation the motor is initially operable as long as the temperature of the brush is less than 212° C. Once the temperature of the brush reaches 212° C. the operation is terminated until it drops to 176° C. Thereafter, the temperature range of the brush needed for operation is 176° C. to 212° C.

This operating temperature range provides a couple of advantages. First, damage to the motor from heat buildup only occurs at temperatures in excess of 212° C. So no damage occurs to the motor or winch. Second, the cooling curve of an electric motor is steepest from 212° C. down to 176° C. The rate of cooling slows significantly at temperatures below 176° C. So by having 176° C. as the bottom of the temperature operating range the entire "fast" section of the cooling curve are utilized. The motor and winch are returned to service quickly. This maximizes up time and minimizes down time in the duty cycle.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
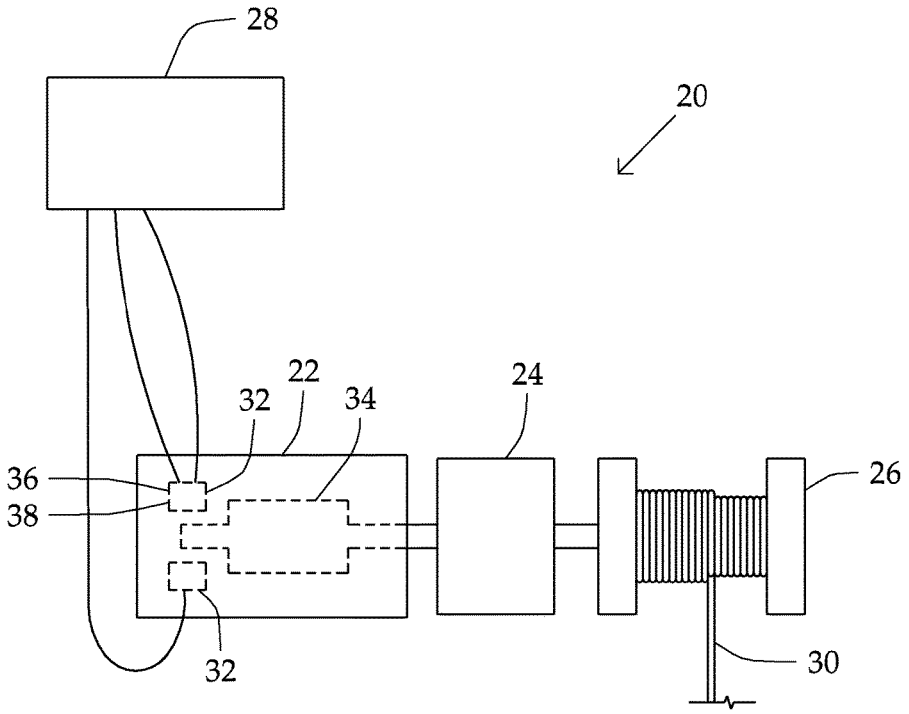
FIG. 1 is a schematic of an electric winch incorporating the preferred embodiment of the present invention.
Figure 3:
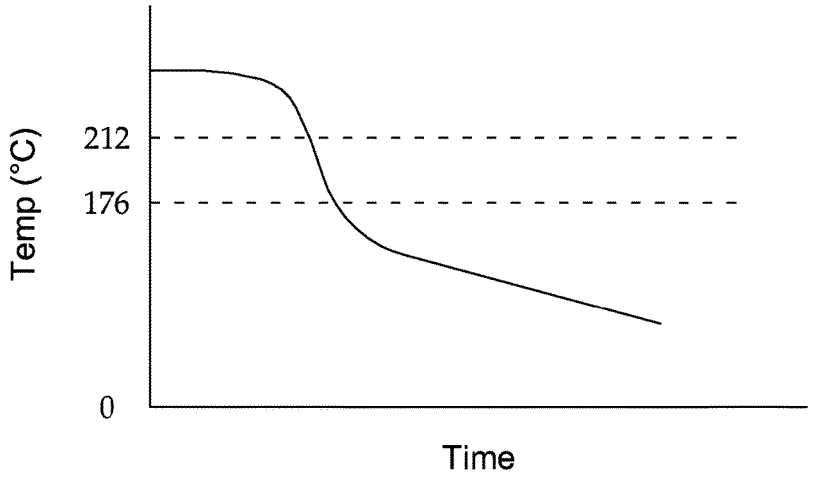
FIG. 3 is the temperature vs. time cooling chart for the electric motor of the winch.
Figure 2:
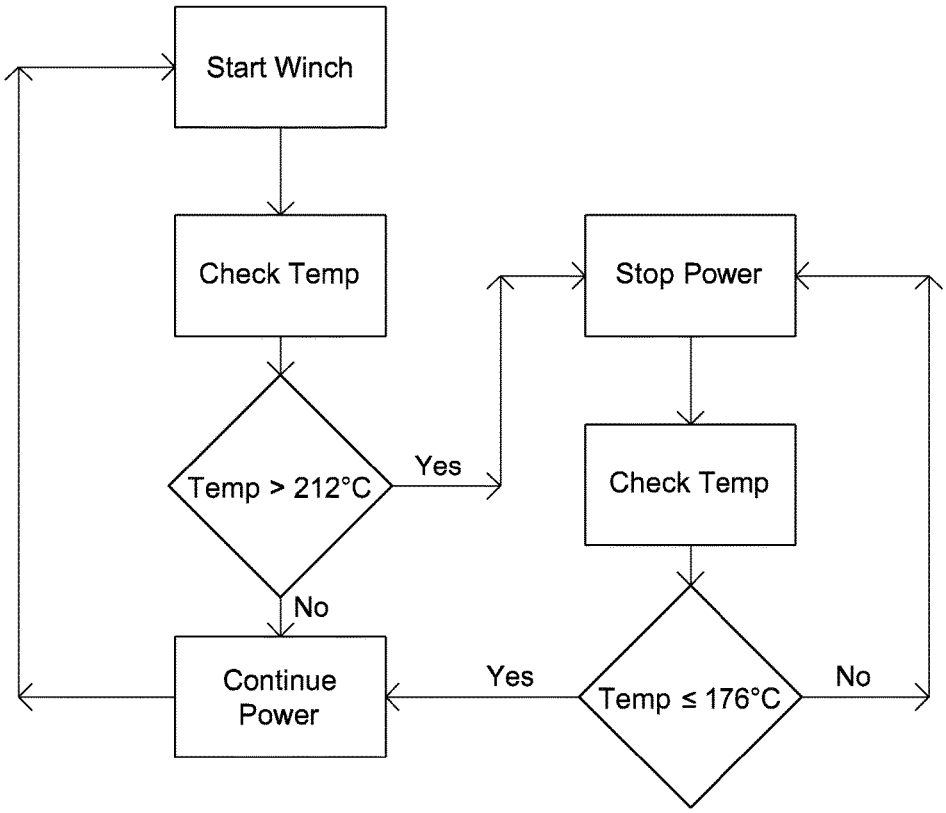
FIG. 2 is a flow chart of the operation of the present invention.

Turning now to the drawings wherein like reference characters indicate like or similar parts throughout, FIGS. 1-3 illustrates the preferred embodiment of the present invention. The electric winch 20 is seen in FIG. 1. It has an electric motor 22, gear train 24, spool 26 and control module 28. Power from the motor 22 is transferred to the spool 26 via the gear train 24. The gear train 24 provides a mechanical advantage for the motor 22 in rotating the spool 26.

The control module 28 controls operation of the electric motor 22. Line 30 is paid out and retrieved through rotation of the spool 26. Direction of rotation of the spool 26 is changed by changing the direction of rotation of the motor 22. The motor 22 is typically a direct current or DC motor. Thus by changing the polarity of the power the direction of rotation can be changed. The polarity of the power is controlled by the control module 28.

The motor 22 has brushes 32 which transfer the electrical power to the field windings 34. The brushes 32 are the most heat intensive piece of the motor 22. In the preferred embodiment the temperature of at least one of the brushes 32 is monitored by a temperature sensor 36. While other temperature sensors 36 may be used, the preferred embodiment uses a thermocouple 38 to monitor this temperature.

The thermocouple 38 is coupled or otherwise attached to the brush 32. The temperature reading of the brushes 32 is fed to the control module 20.

As best seen in FIG. 2, the cooling range or fastest cooling temperature range for the electric motor 22 is from 212° C. down to 176° C. By using 212° C. as the upper limit of the operating limit and cooling range and then reinstating operation once the temperature of the electric motor 22 reaches 176° C. or the lower limit of the cooling range, the amount of shut down cooling time is minimized and the amount of operating time is maximized. The exact temperatures of the upper and lower limits of the cooling range may vary depending upon the materials used for the motor 22 and the design of the motor 22 and its housing.

When the operation of the winch 20 is started it is at ambient temperature. This would most likely be anywhere from −30° C. to 45° C. The operation of the winch 20 continues uninterrupted until the temperature of the motor 22, as measured by the temperature sensor 36 in the brush 32, reaches 212° C. At that point, the control module 28 suspends operation of the motor 22, and in turn, the winch 20, until the temperature of the motor 22 reaches 176° C. At this point, the control module 28 reinstates operation of the motor 22, and in turn, the winch 20. Operation of the winch 20 continues uninterrupted until the temperature of the motor 22 reaches 212° C. At that point, the cooling cycle is initiated taking the motor 22 and winch 20 out of service until the lower temperature (176° C.) is reached.

It should be noted, the gear train 24 could be planetary or traditional. Further, other types of temperature sensor 36 could be used with the present invention in lieu of the thermocouple.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A method for increasing a duty cycle of an electric winch motor, the method comprising:

maintaining operation of the electric winch motor within a predetermined cooling range by way of a programmable control module in communication with the electric winch motor;

the programmable control module:

suspending operation of the electric winch motor when a motor temperature is equal to a selected upper limit of the predetermined cooling range; and resuming operation of the electric winch motor when the motor temperature is equal to a selected lower limit of the predetermined cooling range.

2. The method of claim 1 further comprising querying, using the programmable control module, a motor temperature detected by a temperature sensor.

3. The method of claim 2, wherein the motor temperature is a brush temperature.

4. The method of claim 3, wherein the temperature sensor includes a thermocouple.

5. The method of claim 1, wherein the selected upper limit of the predetermined cooling range is approximately 212° C.

6. The method of claim 1, wherein the selected lower limit of the predetermined cooling range is approximately 176° C.

7. The method of claim 1, the predetermined cooling range lying on a slope of a time-temperature cooling curve for the electric winch motor.

8. The method of claim 7, the slope being a maximum slope of the time-temperature cooling curve.

9. The method of claim 8, wherein the selected upper limit is a temperature toward an upper end of the maximum slope of the time-temperature cooling curve.

10. The method of claim 8, wherein the selected lower limit is a temperature toward a lower end of the maximum slope of the time-temperature cooling curve.

11. A winch comprising:

an electric winch motor including one or more brushes;

a temperature sensor arranged to indicate a motor temperature of the electric winch motor;

a programmable control module in communication with the electric winch motor and the temperature sensor, the programmable control module including a time-temperature cooling curve for the electric winch motor and a predetermined cooling range for the electric winch motor along a slope of the time-temperature curve;

the programmable control module operable to maintain operation of the electric winch motor when the motor temperature is between selected upper and lower limits of the predetermined cooling range and suspend operation when the motor temperature is at the selected upper limit.

12. The winch of claim 11 further comprising:

the programmable control module being operable to reinstate the operation of the electric motor after operation is suspended.

* * * * *